US007281616B2

(12) United States Patent
Peterson et al.

(10) Patent No.: US 7,281,616 B2
(45) Date of Patent: Oct. 16, 2007

(54) EXPANDABLE LUGGAGE

(75) Inventors: Shep Peterson, Vidalia, GA (US); Robert P. Davis, Vidalia, GA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 10/924,082

(22) Filed: Aug. 23, 2004

(65) Prior Publication Data

US 2006/0037823 A1 Feb. 23, 2006

(51) Int. Cl.
*A45C 7/00* (2006.01)

(52) U.S. Cl. ..... 190/103; 190/105; 220/8; 383/2

(58) Field of Classification Search ..... 190/102–105, 190/107; 383/2; 220/8
See application file for complete search history.

(56) References Cited

U.S. PATENT DOCUMENTS 764,144 A * 7/1904 McGowan ..... 190/105
2,110,617 A * 3/1938 Wolff ..... 190/105
3,175,853 A * 3/1965 Gilbertson ..... 292/86
3,443,671 A * 5/1969 Dyke ..... 190/103
4,724,976 A * 2/1988 Lee ..... 220/8
5,819,891 A * 10/1998 Wang et al. ..... 190/103
6,220,411 B1 4/2001 Scicluna et al. ..... 190/103
6,305,513 B1 * 10/2001 Lu ..... 190/103
6,390,259 B1 * 5/2002 Lu ..... 190/103
6,575,272 B1 * 6/2003 Krulik et al. ..... 190/103
2002/0040834 A1 * 4/2002 Chen ..... 190/103

* cited by examiner

*Primary Examiner*—Sue A. Weaver
(74) *Attorney, Agent, or Firm*—Baker Botts L.L.P.

(57) ABSTRACT

An item of expandable luggage includes a substantially rigid main peripheral frame and a substantially rigid secondary peripheral frame. A peripherally continuous gusset of flexible material is connected between the two peripheral frames. Opposite wall panels of the main peripheral frame are joined to corresponding opposite wall panels of the secondary peripheral frame by bridge assemblies, one such assembly being associated with each of the opposite wall panels of the respective frames. Each bridge assembly includes a receiving member affixed to the wall panel of the first component, the receiving member having an aperture therein, and a substantially rigid bridge plate affixed to the wall panel of the second component and slidably received by the receiving members, the plate having a first and second tongue capable of cooperating with the aperture.

13 Claims, 3 Drawing Sheets

EXPANDABLE LUGGAGE

FIELD OF THE INVENTION

The present invention relates to luggage, especially travel luggage, and in particular to luggage that can be expanded when desired.

BACKGROUND INFORMATION

The needs of travelers for luggage space can vary considerably, depending on the duration of a trip, the nature of the trip in terms of the types of clothing and other gear required, and the climate of the destination. For example, regardless of the purpose and the climate, a traveler does not need as much luggage space for a trip of short duration as for a long one. Generally, a business traveler does not need as much luggage space as a recreational traveler, especially one who needs both casual and dress clothes.

One way for travelers to provide for both smaller and larger luggage space requirements is to have a moderately-sized suitcase for some trips and a large one for other trips. Another way is to have two moderate-sized suitcases and use only one when possible and use both when a larger capacity is needed. There have also been various proposals for expandable luggage. An expandable item of luggage offers the traveler a possible savings in cost as compared to the costs of purchasing more than one piece of luggage. Moreover, the capability of expanding a piece of luggage permits a traveler to change the carrying capacity during the course of a trip. Not infrequently, a traveler will make purchases on a trip and will need more room for the return trip than for travel to a destination.

Most previously known luggage having a variable volume is of the "soft" type, such as a duffle bag with expandable sections that can be collapsed and secured to a main section. The expandable "hard" luggage that is currently available lacks rigidity when expanded due to inadequate linking of separate rigid frame components that move away from each other when the luggage is expanded.

BRIEF SUMMARY OF THE INVENTION

An object of the present invention is to provide an item of expandable luggage of the "hard" type that has a high degree of geometric stability when expanded. It is, in particular, an objective of the invention to provide a highly effective coupling between two frame components that move apart when the luggage item is expanded so that relative movements of the two frame components are minimized. A further object is to provide a hard expandable luggage item that is easily changed between a smaller volume and a larger volume.

The foregoing objects are attained, in accordance with the present invention, by an item of expandable luggage that includes a frame having a first substantially rigid component and a second substantially rigid component, each of which includes a pair of opposite rectangular planar wall panels and which together with a pair of wall members form the peripheral boundary of a variable volume receptacle and a rectangular area. A peripherally continuous gusset of flexible material is connected between the wall panels and wall members of the two frame components and provides, when the luggage item is expanded, a portion of the peripheral wall of the receptacle. A bridge assembly joins each wall panel of the first component to a corresponding wall panel of the second component in coplanar relation and for linear displacement of the two components toward and away from each other. Each bridge assembly includes a receiving member affixed to the wall panel of the first component, the receiving member having an aperture therein; and a substantially rigid bridge plate affixed to the wall panel of the second component and slidably received by the receiving members, the plate having a first and second tongue capable of cooperating with the aperture. When the tongue on each bridge assembly is depressed, this permits latching of the bridge plate to the wall panel of the first component in at least one position in which the second component is held spaced apart from the first component.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE PREFERRED EMBODIMENTS

Figure 1:
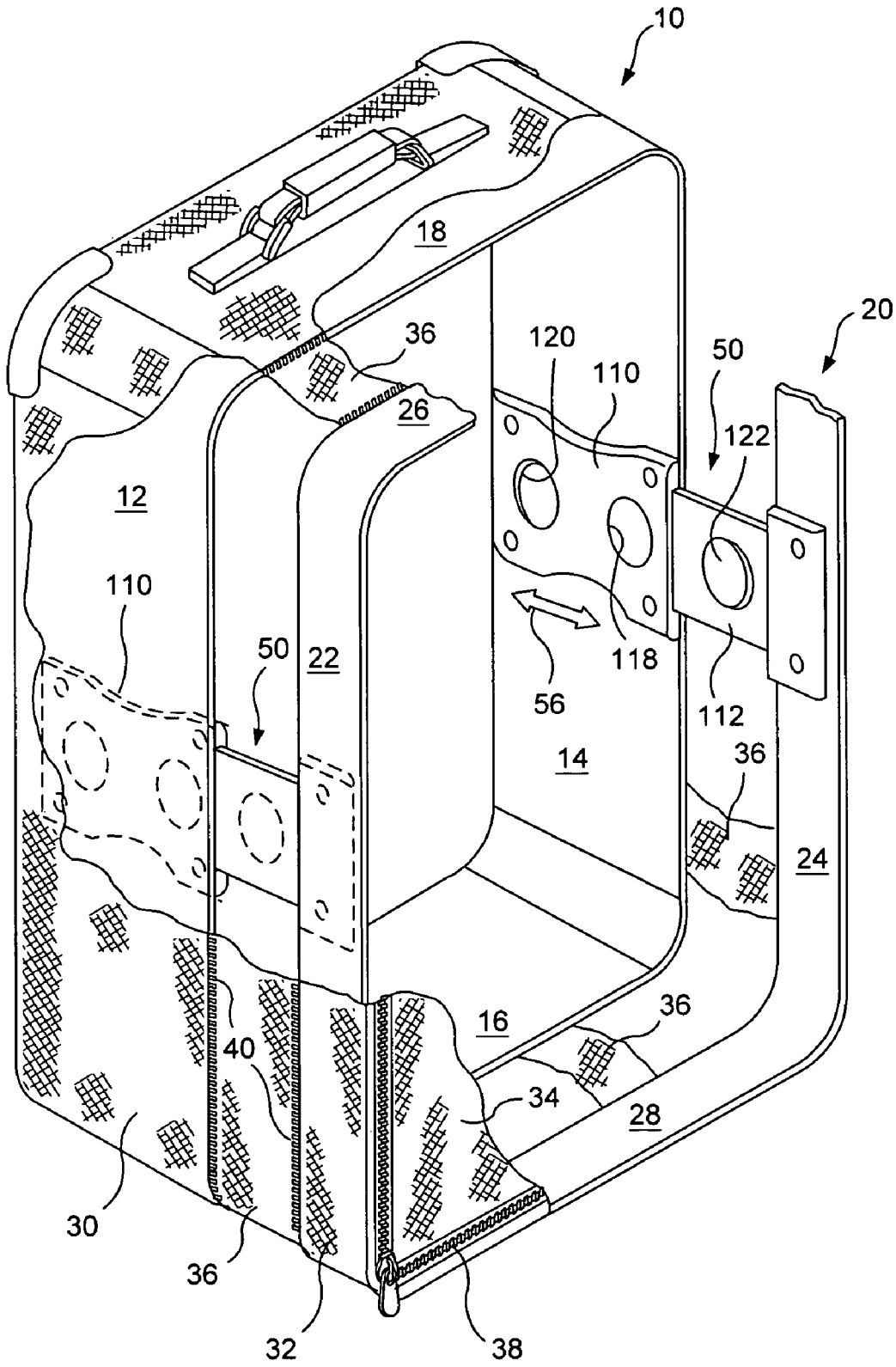
FIG. 1 is a generally schematic three-quarter front pictorial view of a first exemplary embodiment according to the present invention, with portions broken away.

The embodiment shown in FIG. 1 has a two-component frame, which may be of any suitable specific construction in terms of materials, manner of assembly, and configurations of the parts. A main frame component 10 may have a pair of rectangular planar side wall panels 12 and 14, a bottom wall member 16 and a top wall member 18, which may be substantially rigid and rigidly connected at the corners. Although FIG. 1 shows the bottom and top members as panels, most travel luggage being marketed currently is of the towable, wheeled type. In practice for such luggage items, the bottom member and top member of the main frame may be configured to accept wheels, a towing handle, a carrying handle, and the like. The main frame component 10 may also have a partial or complete rigid back wall panel. A secondary frame component 20 may be formed of opposite rectangular planar panels 22 and 24 and top and bottom members 26 and 28, which as a practical matter should usually also be rectangular planar panels of sheet material.

The main frame component 10 may receive a cover 30 of a durable fabric. The sides, top and bottom of the secondary frame may receive a fabric cover 32. Access to the interior of the luggage item may be through a front opening that is closed by a panel 34, may be joined to the cover 32 at the bottom edge and may be opened and closed by use of a zipper 38 along three sides.

The main part (main frame 10 and its cover 30) of the luggage item may be joined to the secondary part (secondary frame 20 and its cover 32, 34) by a gusset 36 of a durable, flexible material that extends along the entire perimeter of the luggage item (along the top, bottom and both side walls). In the expanded state of the item, the gusset 36 peripherally may bound that part of the entire volume of the main compartment by which the volume of the item may be increased upon movement of the secondary unit away from the main unit. In the collapsed (smaller volume) position (not shown) of the luggage item, a zipper 40 that extends about the entire perimeter of the item may be used to aid in keeping the luggage in the collapsed position. The gusset 36 may fold into the interior of the luggage.

The main frame component 10 may be joined to the secondary frame component 20 by two bridge assemblies 50, preferably substantially identical to each other and one of which may be associated with the side panels 12 and 22 and the other with the side panels 14 and 24.

Referring to FIGS. 2A-2D, each bridge assembly consists of a fixed plate-like member 110 that may be attached to the wall panel 12, 14 of the main frame component 10, and a movable plate 112 that may be slidably received within the fixed member 110 and may be attached at its free end to the secondary frame component 20. The movable plate 112 may be slidable relative to the fixed member 110 between the collapsed position of the luggage item and the expandable position of the luggage item. The fixed member 110 may be formed of two back-to-back plastic plates 116, 130 which form a pocket therebetween. A pair of compression springs 140, 142 (shown only in FIG. 2B, and shown in dotted lines) received in channels 114 in the fixed member 110 may bias the movable plate 112 towards the expanded position. The front plate 116 of the fixed member 110 may include a pair of generally oval apertures 118, 120 (see FIG. 2B) spaced apart in the direction of movement of the slidable plate 112. (For convenience of reference, this direction is referred to herein as the vertical direction, i.e., in the direction of the arrow 56 of FIG. 1) A pair of similarly spaced-apart resiliently elements such as oval-shaped tongues 122, 124 may be formed on the slidable plate 112 and, as described below, may be received in the spaced oval-shaped apertures 118, 120. The inherent resilience of the tongues 122, 124 may bias them towards the front plate 116 of the fixed member 110, so that the upper edge 122*a* of the upper tongue 122 and the lower edge 124*a* of the lower tongue 124 project above the surface of the slidable plate 112 (see FIG. 2B). Alternatively or in addition, springs or other means may also be used to bias the tongues 122, 124 towards the front plate 116.

No new matter has been introduced by way of this amendment, as paragraph [0017] of the specification originally disclosed a pair of compression springs received in channels 114 in the fixed member 110 which may bias the movable plate 112 towards the expanded position.

Figure 2A:
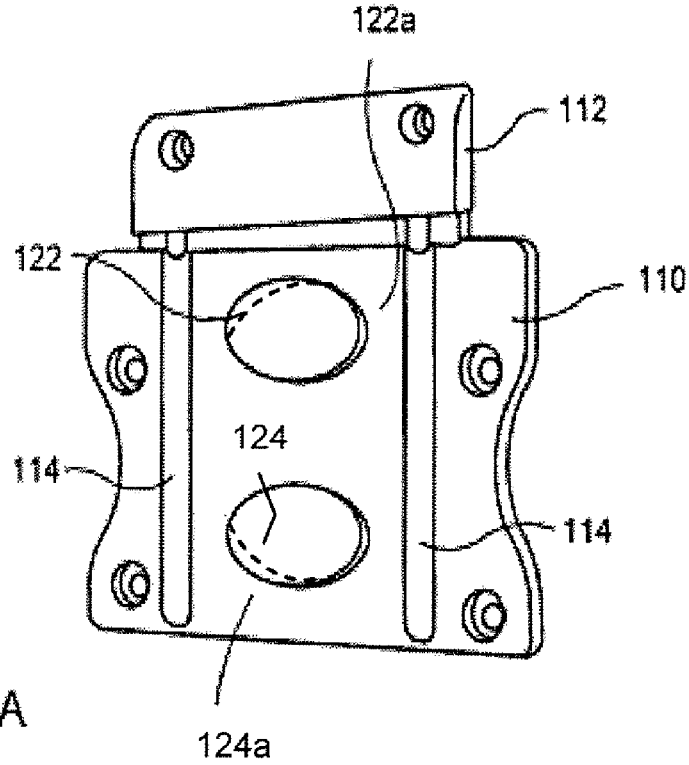
FIG. 2A shows the expansion and locking assembly from the front in a retracted position.

In the collapsed position of the expansion assembly, the upper tongue 122 may be received in the upper oval-shaped aperture 118 and the lower tongue 124 may be coincident with the lower aperture 120 (see FIG. 2A). In an alternate embodiment, no lower aperture is present. Upon receipt in the upper aperture 118, the upper edge 122*a* of the upper tongue 122 may bear against the facing edge of the aperture 118 and may lock the slidable plate 112 against movement towards the expanded position, i.e., upwardly in FIG. 2A. To release the slidable plate 112 for movement to the expanded position, the user may depress the upper tongue 122 by hand, whereupon the compression springs (not shown) urge the slidable plate 112 upwardly to the expanded position. Although the lower tongue 124 may be coincident with the lower oval-shaped aperture 120 in the collapsed position of the bag, it should not impede movement of the sliding plate 112 towards the expanded position because the upper edge of the lower tongue 124 may be flush with the surface of the plate 112.

Figure 2B:
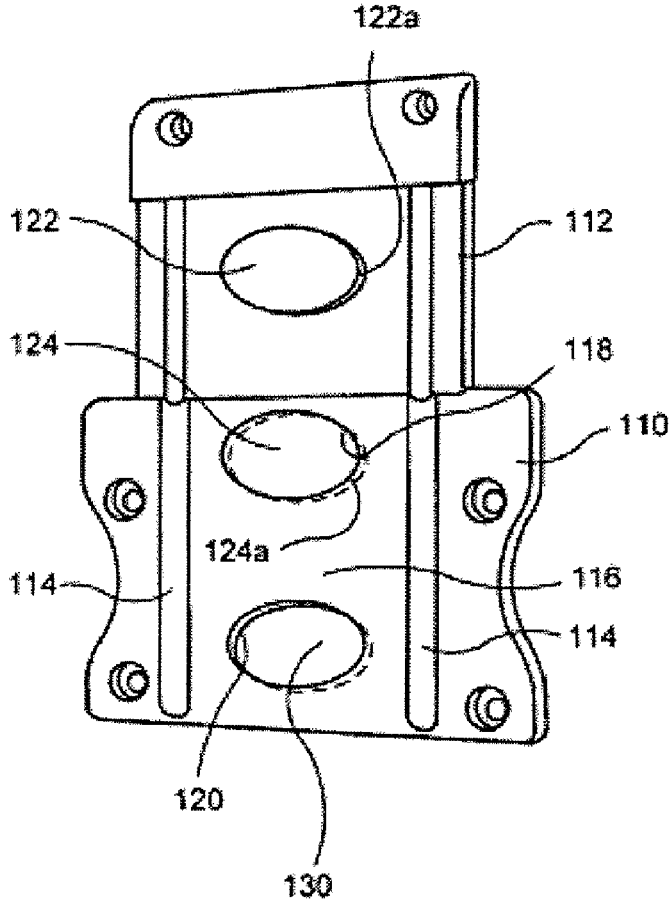
FIG. 2B shows the expansion and locking assembly from the front in an expanded position.

Upon reaching the expanded position, the lower tongue 124 may be biased by its inherent resiliency into the upper aperture 118, where the lower edge 124*a* of the tongue 24 may bear against the lower edge of the upper aperture 118 to lock the slidable plate 112 against movement towards the collapsed position, i.e., downwardly in FIG. 2B. To release the plate 112 from the expanded position, the lower edge 124*a* of the tongue 24 may be depressed, by hand, out of engagement with the lower edge of the upper aperture 118. The plate 112 may then be pushed downward into the fixed member 110 against the biasing force of the compression springs. The upper tongue 122 should not impede movement of the plate 112 into the fixed member 110 because the lower edge of the tongue 122 may be flush with the surface of the plate 112.

Although, as shown in FIG. 2A, the lower tongue 124 may be coincident with the lower aperture 120 when the slidable plate 112 may be in the collapsed position, the lower aperture 120 should not function to lock the slidable plate 112 in either the collapsed position or the expanded position. Instead, the plate 112 may be locked against movement upwardly away from the collapsed position by engagement of the upper edge 122*a* of the upper tongue 122 with the downwardly-facing upper edge of the upper aperture 118 and against movement downwardly away from the expanded position (e.g., FIG. 2B) by engagement of the lower edge 124*a* of the lower tongue 124 with the upwardly-facing lower edge of the upper aperture 118. Thus, the purpose of the lower aperture 120 may be to permit the lower tongue 124 to return to its rest position rather than being captured against its own inherent resiliency within the pocket of the fixed member 110.

Figure 2C:
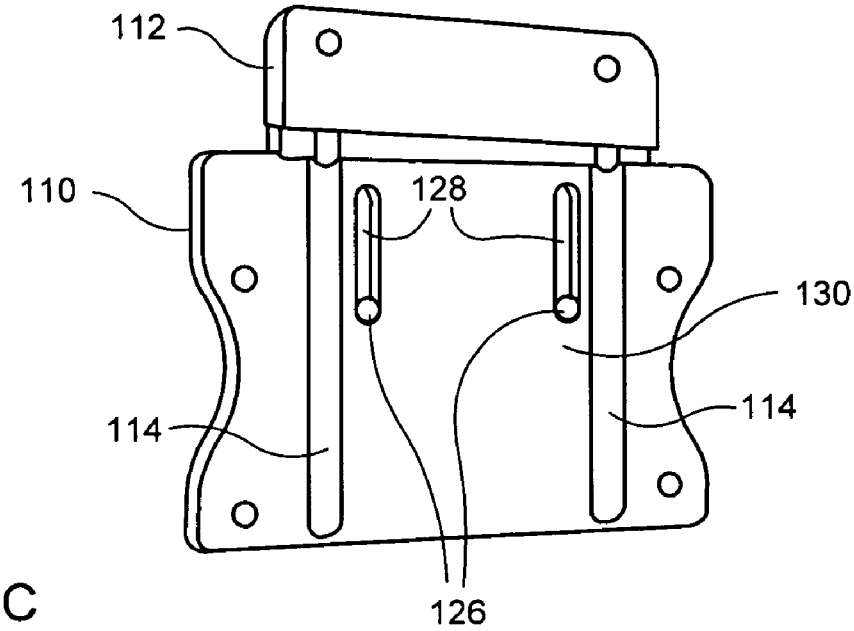
FIG. 2C shows the expansion and locking assembly from the rear in the retracted position.
Figure 2D:
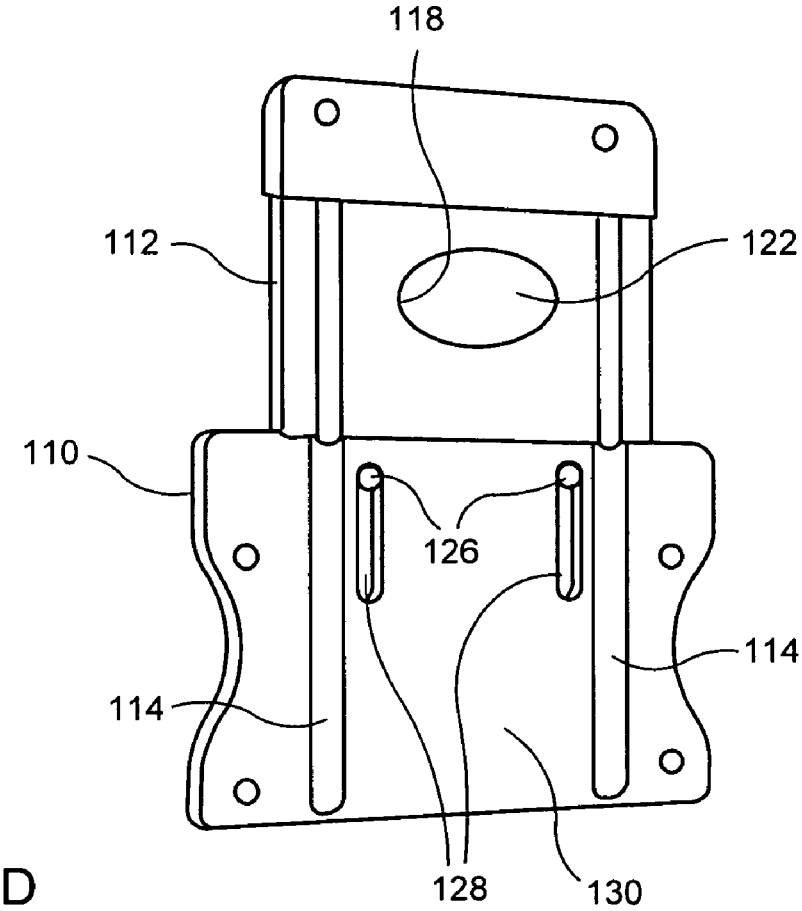
FIG. 2D shows the expansion and locking assembly from the rear in the an expanded position.

The length of travel of the sliding plate 112 may be limited, in the upward direction, by engagement of a pair of lugs 126 on the inner surface of the sliding plate 112 with the upper ends of a pair of elongate slots 128 in the rear plate 130 of the fixed member 110, as depicted in FIGS. 2C and 2D. In the downward direction, the length of travel of the sliding plate 112 may be limited by engagement of the lower edge of the lower tongue 124 with the upwardly-facing lower edge of the lower aperture 120. The engagement of the lugs 126 with the slots 128 may also serve to guide the plate 112 in its sliding movement relative to the fixed plate 110.

What is claimed is:

1. An item of expandable luggage comprising:

a frame having a first substantially rigid component and a second substantially rigid component, each of which includes a pair of opposite rectangular peripheral wall panels that together with another pair of peripheral wall members form the peripheral boundary of a variable volume enclosure and a generally rectangular area;

a peripherally continuous gusset of flexible material connected between the peripheral wall panels and peripheral wall members of the two frame components; and a bridge assembly joining each wall panel of the first component to a corresponding wall panel of the second component in coplanar relation and for linear displacement of the two components toward and away from each other, each bridge assembly including:

a receiving member coupled to the wall panel of the first component, the receiving member having an edge defining an aperture therein, and a bridge plate coupled to the wall panel of the second component and slidably received by the receiving member, the plate having first and second at least partially resilient elements, each resilient element configured to engageably cooperate with at least a portion of the edge defining the aperture to substantially fix the linear displacement of the two components to each other wherein the at least partially resilient element comprises a tongue having a portion inherently biased toward the surface of the receiving member that includes the aperture and wherein a biased leading edge of the tongue of the first resilient element engages the portion of the edge defining the aperture substantially furthest from the second component and a substantially unbiased following edge of the first resilient element is substantially flush with the portion of the bridge plate surrounding at least a portion of the first resilient element.

2. The item of expandable luggage of claim 1 wherein a biased leading edge of the tongue of the second resilient element engages the portion of the edge defining the aperture substantially nearest to the second component and a substantially unbiased following edge of the second resilient element is substantially flush with the portion of the bridge plate surrounding at least a portion of the second resilient element.

3. The item of expandable luggage of claim 1 wherein the at least partially resilient element is inherently biased toward the surface of the receiving member that includes the aperture.

4. The item of expandable luggage of claim 1 wherein the bridge plate is configured such that depressing the at least partially resilient element on each bridge assembly permits unlatching of the bridge plate to the wall panel of the first component.

5. The item of expandable luggage of claim 1 wherein the bridge plate is configured such that when the at least partially resilient element is aligned with the aperture, the at least partially resilient element engages at least a portion of the edge defining the aperture.

6. The item of expandable luggage of claim 5 wherein the at least partially resilient element is positionable in at least one position in which the second component is held spaced apart from the first component.

7. The item of expandable luggage of claim 1 wherein the bridge assembly further comprises a spring to assist in linear displacement of the two components from each other.

8. The item of expandable luggage of claim 1 wherein the receiving member comprises a first and second member, the first member being adapted to cooperate with a front side of the bridge plate, and the second member being adapted to cooperate with a rear side of the bridge plate.

9. The item of expandable luggage of claim 1 wherein the receiving member further comprises a further aperture capable of permitting the first at least partially resilient element of the bridge plate to rest therein when the two components are displaced toward each other.

10. The item of expandable luggage of claim 1 wherein the first component comprises a main frame component.

11. The item of expandable luggage of claim 1 wherein the first component comprises a secondary frame component.

12. An item of expandable luggage comprising:

a frame having a first component and a second component, each of which includes a pair of opposite rectangular peripheral wall panels that together with another pair of peripheral wall members form the peripheral boundary of a variable volume enclosure;

a peripherally continuous gusset of flexible material connected between the peripheral wall panels and peripheral wall members of the two frame components; and a bridge assembly joining each wall panel of the first component to a corresponding wall panel of the second component in coplanar relation and for linear displacement of the two components toward and away from each other, each bridge assembly including:

a receiving member coupled to the wall panel of the first component, the receiving member having an aperture therein, and a bridge plate coupled to the wall panel of the second component and slidably received by the receiving member, the plate having first and second elements, each element configured to engageably cooperate with the aperture to substantially fix the linear displacement of the two components to each other wherein the element comprises a tongue having a portion inherently biased toward the surface of the receiving member that includes the aperture and wherein each biased leading edge of the tongue of the first and second elements respectfully engages the portion of the edge defining the aperture substantially furthest and nearest from the second component and substantially unbiased following edges of the first and second elements are substantially flush with the portion of the bridge plate surrounding at least a portion of the first and second resilient elements.

13. A bridge assembly joining a pair of opposite wall panels of a first component of a frame of expandable luggage to a corresponding pair of opposite wall panels of a second component of the frame in coplanar relation and for linear displacement of the two components toward and away from each other, the bridge assembly comprising:

a receiving member coupled to the wall panel of the first component, the receiving member having an edge defining an aperture therein, and a bridge plate coupled to the wall panel of the second component and slidably received by the receiving member, the plate having first and second at least partially resilient elements, each resilient element configured to engageably cooperate with at least a portion of the edge defining the aperture to substantially fix the linear displacement of the two components to each other wherein the at least partially resilient element comprises a tongue having a portion inherently biased toward the surface of the receiving member that includes the aperture and wherein a biased leading edge of the tongue of the first resilient element engages the portion of the edge defining the aperture substantially furthest from the second component and a substantially unbiased following edge of the first resilient element is substantially flush with the portion of the bridge plate surrounding at least a portion of the first resilient element.

* * * * *